US009033474B2

(12) United States Patent
Nakashima et al.

(10) Patent No.: US 9,033,474 B2
(45) Date of Patent: May 19, 2015

(54) LIQUID DISCHARGE APPARATUS

(71) Applicant: SEIKO EPSON CORPORATION, Tokyo (JP)

(72) Inventors: Hiromichi Nakashima, Nagano (JP); Noritaka Mitsuo, Nagano (JP); Jun Shimazaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/972,133

(22) Filed: Aug. 21, 2013

(65) Prior Publication Data

US 2014/0063135 A1 Mar. 6, 2014

(30) Foreign Application Priority Data

Aug. 31, 2012 (JP) ..... 2012-192406

(51) Int. Cl.
*B41J 2/175* (2006.01)

(52) U.S. Cl.
CPC ..... *B41J 2/175* (2013.01); *B41J 2/17509* (2013.01)

(58) Field of Classification Search
USPC ..... 347/85, 86
See application file for complete search history.

(56) References Cited

U.S. PATENT DOCUMENTS

2001/0026306 A1* 10/2001 Yamazaki et al. ..... 347/86
2004/0263544 A1* 12/2004 Kojima ..... 347/5
2011/0090270 A1* 4/2011 Harada ..... 347/9

FOREIGN PATENT DOCUMENTS

JP 2007-160749 A 6/2007
JP 2010-089477 A 4/2010

* cited by examiner

*Primary Examiner* — Stephen Meier
*Assistant Examiner* — Alexander D Shenderov
(74) *Attorney, Agent, or Firm* — Global IP Counselors, LLP

(57) ABSTRACT

A liquid discharge apparatus includes an ink tank configured and arranged to retain a plurality of types of ink including sedimentary ink, a head configured and arranged to discharges the ink, and an ink supply path section configured and arranged to supply the ink from the ink tank to the head. The ink supply path section includes a Cableveyor (registered trademark) accommodating a plurality of ink tubes. A plurality of ink tubes for the sedimentary ink among the plurality of ink tubes are mounted at the same height in a height direction inside the Cableveyor (registered trademark).

8 Claims, 9 Drawing Sheets

LIQUID DISCHARGE APPARATUS

CROSS-REFERENCE TO RELATED APPLICATIONS

This application claims priority to Japanese Patent Application No. 2012-192406 filed on Aug. 31, 2012. The entire disclosure of Japanese Patent Application No. 2012-192406 is hereby incorporated herein by reference.

BACKGROUND

1. Technical Field

The present invention relates to a liquid discharge apparatus.

2. Related Art

So-called ink jet printers which form an image by discharging ink are in use. Among these ink jet printers, there are printers which are able to discharge sedimentary ink such as white ink.

In ink jet printers, ink is supplied to a head in an inner section of the ink jet printer. In particular, the head and an ink tank are separated in printers of a type which performs large format printing due to the large amount of ink which is used and ink is supplied through an ink tube which is mounted between the head and the ink tank.

An image forming apparatus and a liquid container are shown in Japanese Unexamined Patent Application Publication No. 2007-160749.

SUMMARY

However, in the inks which are used, there are inks where significant sedimentation appears. In addition, there are printing apparatuses for industrial applications where not only are the head and ink tank arranged to be separated but an ink flow path which connects the head and the ink tank has differences in elevation in the vertical direction of 100 mm or more, in particular, 300 mm or more in large printing apparatuses.

In the printing apparatuses in the prior art, it is necessary for the ink concentration to be made to be uniform by stirring the ink in cases where ink sediment is generated. However, although sediment is generated in the lowest portion of the ink flow path and the vicinity of the lowest portion in cases where the differences in elevation in the ink flow path are small, it is possible to facilitate removal of sediment using circulation inside the ink flow path since the length of the ink flow path is short and the amount of ink is low.

On the other hand, in the large printing apparatuses described above, as a result of the length of the ink flow path being expanded due to expanding of the differences in elevation of the ink flow path as described above and there being sediment due to a large amount of the sediment component being concentrated at a lower section in the vertical direction, there are concerns that a long time may be necessary for the sediment removal operation and that the sediment removal may be difficult in practice, which is not preferable.

Therefore, in a large printing apparatus which supplies ink where the sediment is significant using an ink flow path which has large differences in elevation in the vertical direction, it is preferable to facilitate the operation of removing sediment.

The present invention has an object of facilitating an operation of removing sediment in an apparatus which supplies sedimentary ink in consideration of these circumstances.

A liquid discharge apparatus according to one aspect includes an ink tank configured and arranged to retain a plurality of types of ink including sedimentary ink, a head configured and arranged to discharges the ink, and an ink supply path section configured and arranged to supply the ink from the ink tank to the head. The ink supply path section includes a Cableveyor (registered trademark) accommodating a plurality of ink tubes. A plurality of ink tubes for the sedimentary ink among the plurality of ink tubes are mounted at the same height in a height direction inside the Cableveyor (registered trademark).

Other characteristics of the present invention will be clarified using description in the present specifications and attached diagrams.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
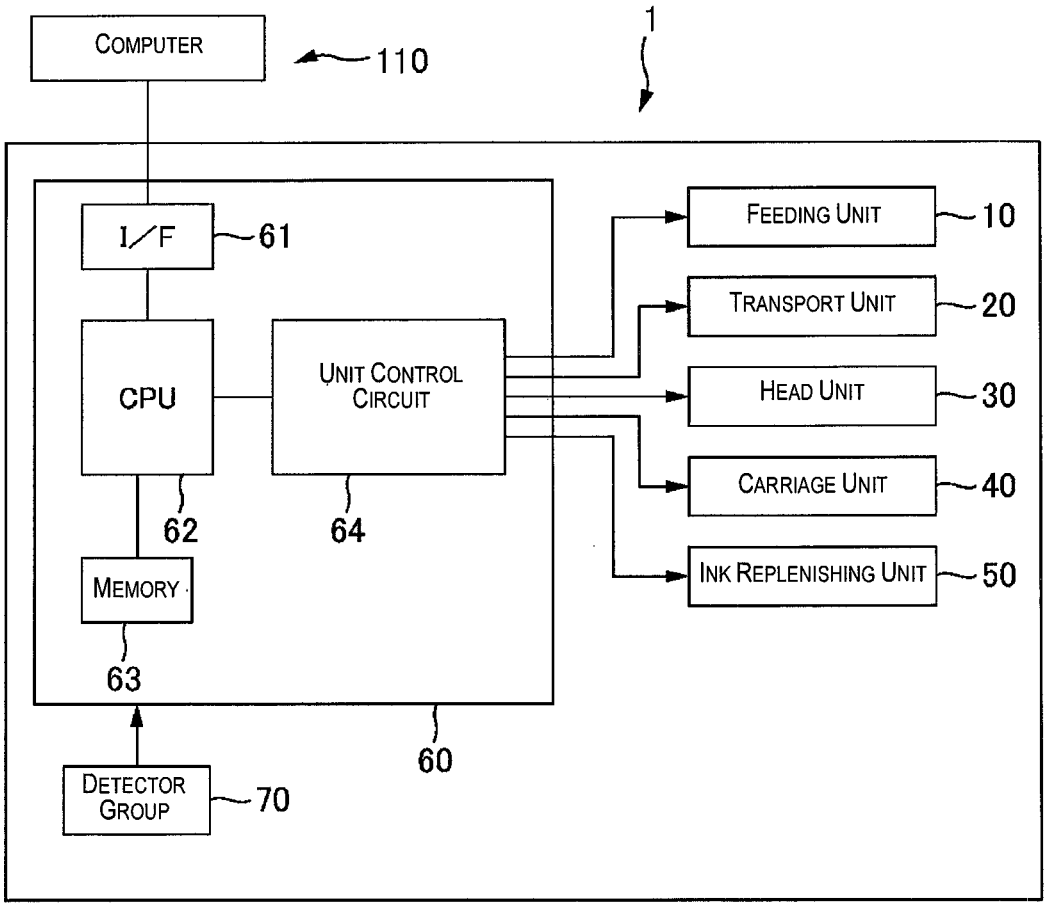
FIG. 1 is a block diagram of a printer 1 of an embodiment.

At least the following items will be explained using description in the present specifications and attached diagrams.

That is, a liquid discharge apparatus including an ink tank configured and arranged to retain a plurality of types of ink including sedimentary ink, a head configured and arranged to discharges the ink, and an ink supply path section configured and arranged to supply the ink from the ink tank to the head. The ink supply path section includes a Cableveyor (registered trademark) as an elongated member supporting and guiding apparatus, which accommodates a plurality of ink tubes. A plurality of ink tubes for the sedimentary ink among the plurality of ink tubes are mounted at the same height in a height direction inside the Cableveyor (registered trademark).

Assuming a case where there are differences in elevation in the tubes for the sedimentary ink where sediment is easily generated, it is easy for sedimentation of the sedimentary ink to occur due to the sediment being concentrated at the low positions. However, it is possible for it to be difficult for a state to occur where the ink in a specific ink tube is concentrated and becomes sediment by setting the heights of the plurality of tubes for the sedimentary ink to the same height inside the Cableveyor (registered trademark) where at least the tubes are accommodated as described above. That is, it is possible to facilitate an operation of removing the sediment inside the apparatus which supplies the sedimentary ink.

In the liquid discharge apparatus, it is preferable that the Cableveyor (registered trademark) have a plurality of mounting heights for the ink tubes inside the Cableveyor (registered trademark), that a bonding section of the ink tubes for the sedimentary ink and the head be positioned at a higher section than the lowest tube in the Cableveyor (registered trademark), and that the ink tubes for the sedimentary ink be mounted at a position which is the highest mounting height inside the Cableveyor (registered trademark).

With this arrangement, since it is possible to reduce the differences in elevation in the ink tubes of the sedimentary ink in the tubes between the head and the Cableveyor (registered trademark), it is possible for it to be difficult for a state to occur where ink is concentrated and becomes sediment.

In addition, the Cableveyor (registered trademark) may have a plurality of mounting heights inside the Cableveyor (registered trademark), the bonding section of the ink tubes for the sedimentary ink and the head may be positioned at a lower section than the lowest tubes in the Cableveyor (registered trademark), and the ink tubes for the sedimentary ink may be mounted at a position which is the lowest mounting height inside the Cableveyor (registered trademark).

Also, due to this, since it is possible to reduce the differences in elevation in the ink tubes for the sedimentary ink in the tubes between the head and the Cableveyor (registered trademark), it is possible for it to be difficult for a state to occur where the ink in specific ink tubes is concentrated and becomes sediment.

In addition, it is preferable that the ink tubes for the sedimentary ink between the Cableveyor (registered trademark) and the head be tubes with a stepped shape.

With this arrangement, since it is possible to increase the proportion of the portion where the ink tubes are horizontal in the tubes between the head and the Cableveyor (registered trademark), it is possible for it to be difficult for a state to occur where ink is concentrated and becomes sediment.

In addition, it is preferable that a holding platform which holds the ink tubes for the sedimentary ink be provided at the same height as the mounting height of the ink tubes for the sedimentary ink in the Cableveyor (registered trademark) between the ink tank and the Cableveyor (registered trademark).

With this arrangement, since it is possible to increase the proportion of the portions where the ink tubes are horizontal before the ink tubes for the sedimentary ink enter the Cableveyor (registered trademark), it is possible for it to be difficult for a state to occur where ink is concentrated and becomes sediment.

In addition, it is preferable that the holding platform be able to move up and down in the height direction.

With this arrangement, it is possible to perform maintenance on the ink tubes for the sedimentary ink by moving the holding platform up and down even when the holding platform is provided at a high position in order to be the same height as the mounting height of the ink tubes for the sedimentary ink inside the Cableveyor (registered trademark).

In addition, it is preferable that a surplus length to the extent of the possible change in the height direction when up and down movement of the holding platform is performed in the height direction be provided in the ink tubes for the sedimentary ink between the Cableveyor (registered trademark) and the holding platform.

With this arrangement, it is also possible to move the positions of the tubes for the sedimentary ink in accordance with the holding platform when the holding platform is moved up and down.

In addition, it is preferable that the ink tubes for the color inks out of the plurality of types of ink be mounted at positions which are lower than the holding platform in at least a portion between the ink tank and the Cableveyor (registered trademark).

With this arrangement, it is possible to increase the ease of maintenance of the ink tubes due to the ink tubes being provided at a lower section of the liquid discharge apparatus with regard to the color ink where it is difficult for ink sediment to be generated.

Embodiment

Figure 2:
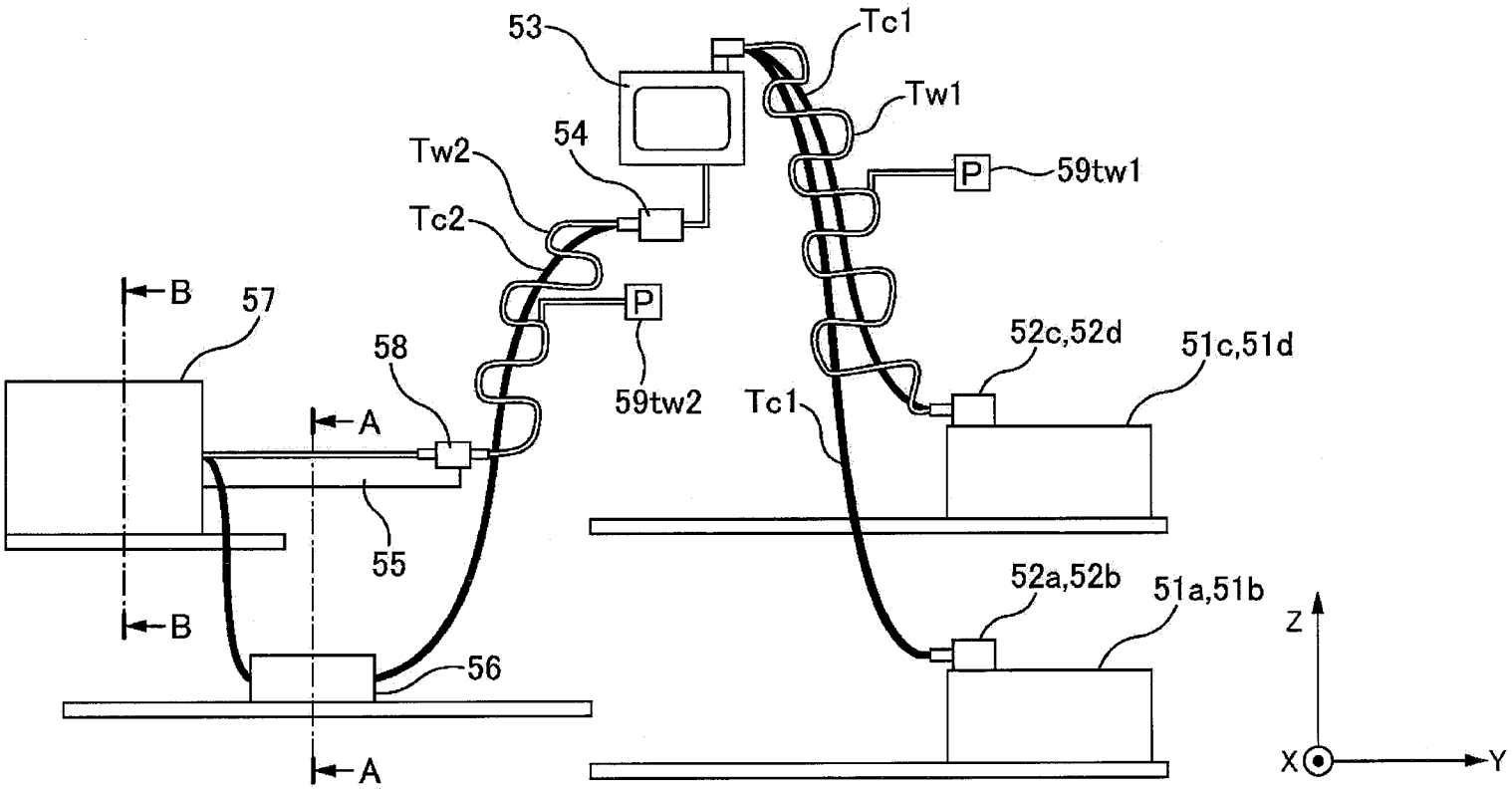
FIG. 2 is a schematic side surface diagram of an inner section of the printer 1 of the embodiment.
Figure 3:
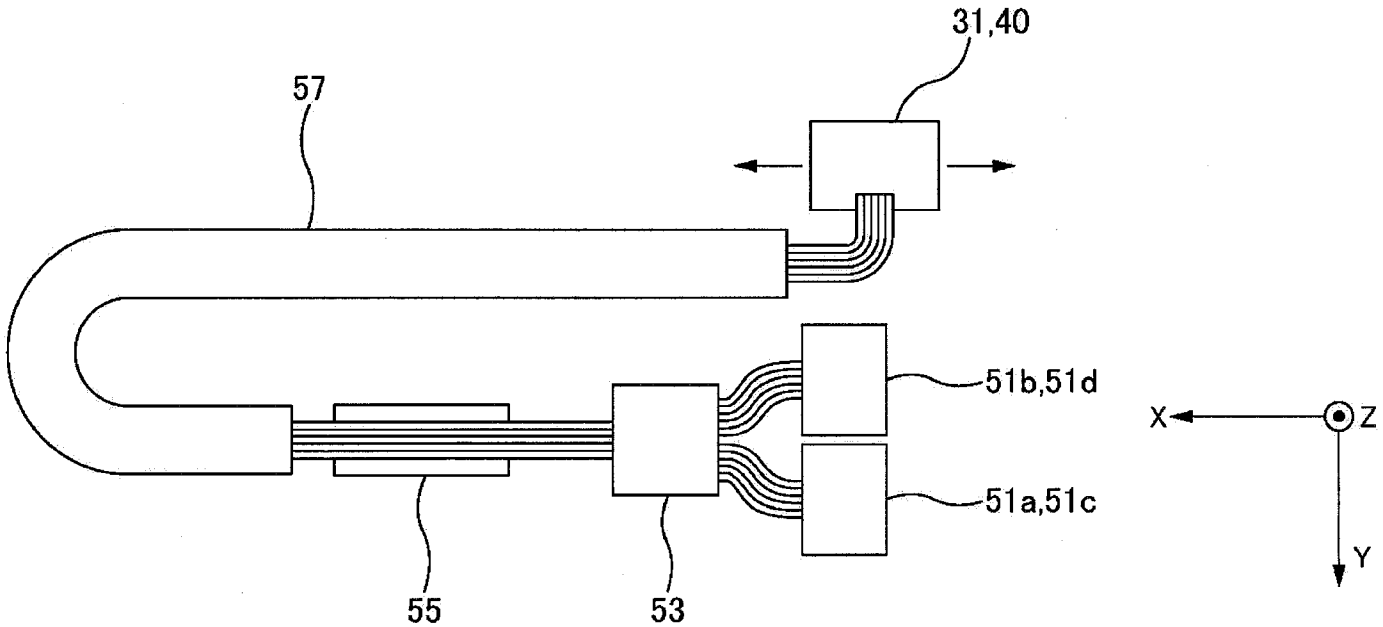
FIG. 3 is a schematic upper surface diagram of the inner section of the printer 1 of the embodiment.
Figure 4:
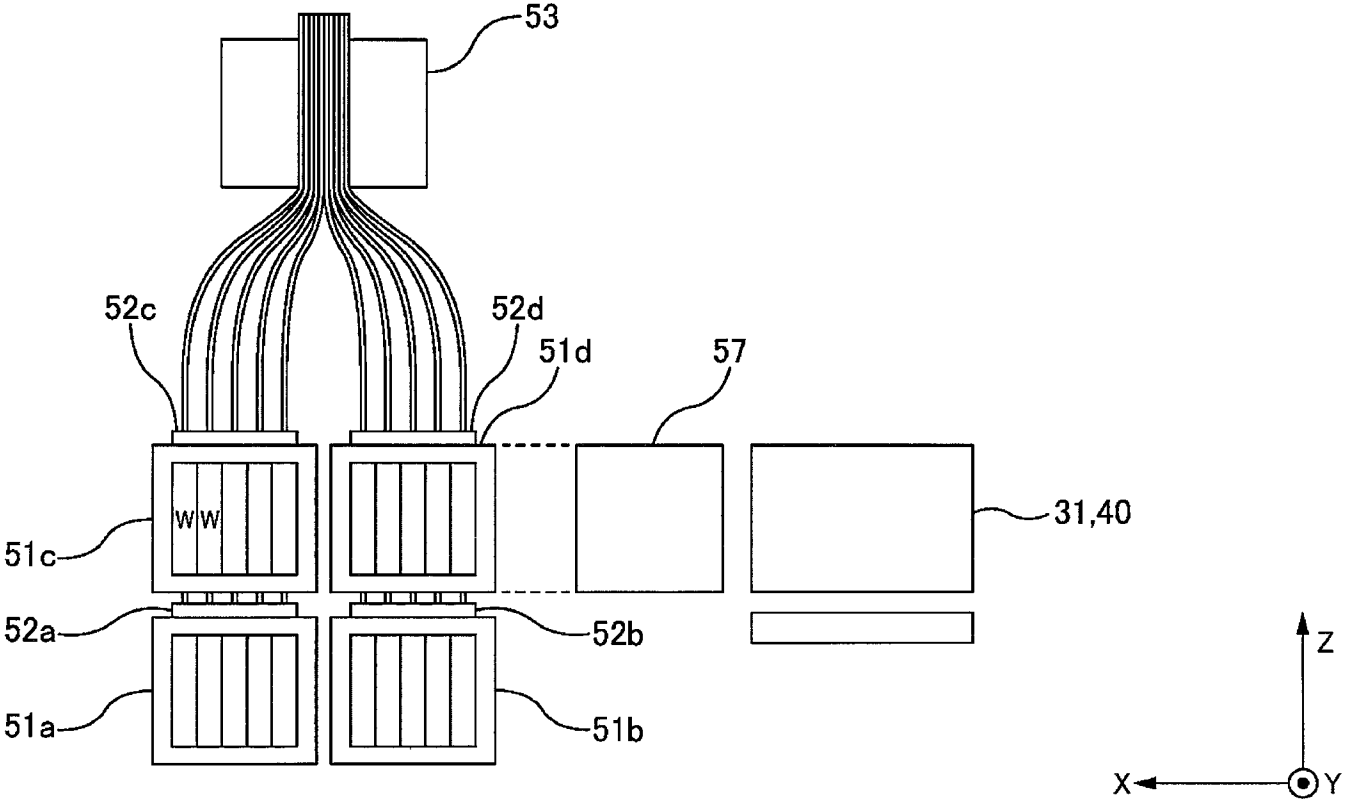
FIG. 4 is a schematic rear surface diagram of the inner section of the printer 1 of the embodiment.

FIG. 1 is a block diagram of a printer 1 in the present embodiment. FIG. 2 is a schematic side surface diagram of an inner section of the printer 1 of the present embodiment. FIG. 3 is a schematic upper surface diagram of an inner section of the printer 1 of the present embodiment. FIG. 4 is a schematic rear surface diagram of an inner section of the printer 1 of the present embodiment.

The printer 1 of the present embodiment is a so-called ink jet printer and performs printing on a printing medium by discharging ink from a head which will be described later. As a result, the printer 1 is provided with a feeding unit 10, a transport unit 20, a head unit 30, a carriage unit 40, an ink replenishing unit 50, a controller 60, and a detector group 70.

The feeding unit 10 feeds a printing medium in the shape of a roll which is not shown in the diagram to the transport unit 20 which will be described later. The transport unit 20 transports the printing medium which is fed from the feeding unit 10 along a transport path which is set in advance. Then, the printing medium is correctly transported and supplied to the position of the head which will be described later.

The head unit 30 is for recording an image at a predetermined part on the printing medium which is supplied on the transport path. The head unit 30 is provided with a head 31 and performs printing by discharging ink, which is supplied as will be described later, onto the printing medium. The carriage unit 40 is for holding the head 31 and moving the head 31 in a predetermined direction. In this manner, it is possible to form an image in a planar direction on the printing medium by the head 31 being held and moved in the predetermined direction.

The ink replenishing unit 50 is a unit for supplying ink to the head 31. The ink replenishing unit 50 will be described later.

The controller 60 is a control unit for performing control of the printer 1. The controller 60 has an interface section 61, a CPU 62, a memory 63, and a unit control circuit 64. The interface section 61 is a computation processing apparatus for performing control of a computer 110 which is an external apparatus and the entire printer 1. The memory 63 is for securing a region for storing programs for the CPU 62, a working region, and the like. The CPU 62 controls each of the units using the unit control circuit 64 which follows the programs which are stored in the memory 63.

The detector group 70 monitors the circumstances inside the printer 1. Due to this, the front edge of a medium and the like is detected and correct transport control of the printing medium such as correction of meandering is performed.

Next, the ink replenishing unit 50 will be described while referencing FIG. 2 to FIG. 4 in particular. Here, the XYZ axes are shown in order to clarify the respective directions in the diagrams.

The ink replenishing unit 50 is provided with ink cartridge accommodating sections 51*a* to 51*d*, cartridge side solenoid valves 52*a* to 52*d*, a relay tank 53, an upstream side solenoid valve 54, a holding platform 55, a cable duct 56, a Cableveyor (registered trademark) 57, a downstream side solenoid valve 58, and circulation pumps 59.

Here, in the ink replenishing unit 50 which is provided with the above, from the ink cartridge accommodating sections 51*a* to 51*d* to the relay tank 53 is set as a first ink flow path section for convenience of description. Then, a white ink tube in the first ink flow path section is set as Tw1 and the other tubes are set as Tc1. In addition, from the relay tank 53 to the inlet of the Cableveyor (registered trademark) 57 is set as a second ink flow path section. Then, a white ink tube in the second ink flow path section is set as Tw2 and the other tubes are set as Tc2. In addition, the inside of the Cableveyor (registered trademark) 57 is set as a third ink flow path section. Then, a white ink tube in the third ink flow path section is set as Tw3 and the other tubes are set as Tc3. In addition, from the outlet of the Cableveyor (registered trademark) 57 to the head 31 is set as a fourth ink flow path section. Then, a white ink tube in the fourth ink flow path section is set as Tw4 and the other tubes are set as Tc4.

The ink cartridge accommodating sections 51*a* to 51*d* are provided in a total of four locations by being provided in each of two locations in terms of up, down, left, and right. The ink cartridge accommodating sections 51*a* to 51*d* each accommodate five ink cartridges and ink in the ink cartridges is pumped to the relay tank 53 using a pump which is not shown in the diagrams. In addition, the cartridge side solenoid valves 52*a* to 52*d* are respectively attached in the ink cartridge accommodating sections 51*a* to 51*d* and control the supply of ink to the relay tank 53. The opening and closing of the cartridge side solenoid valves 52*a* to 52*d* is controlled by the controller 60.

There are a white ink cartridge, a head storage liquid cartridge which is used for maintenance, a liquid retention ink cartridge, and a plurality of color ink cartridges in the ink cartridges which are accommodated. As the plurality of color ink cartridges, for example, there are eight colors of ink cartridges which are a yellow ink cartridge, a magenta ink cartridge, a cyan ink cartridge, a black ink cartridge, a light magenta ink cartridge, a light cyan ink cartridge, a green ink cartridge, and an orange ink cartridge.

Then, the same type of ink cartridges out of the plurality of color ink cartridges are each accommodated in two of the ink cartridge accommodating sections. The head storage liquid cartridge and the liquid retention ink cartridge are each accommodated in one of the ink cartridge accommodating sections. In addition, white ink cartridges W are accommodated in two of the ink cartridge accommodating sections. In particular, the white ink cartridges W with white ink in the present embodiment are accommodated in the ink cartridge accommodating sections 51*c* and 51*d* which are in an upper section out of the ink cartridge accommodating sections which are above and below.

The white ink in the present embodiment is, for example, ink for printing a background color (white) in a color image when performing printing on a transparent printing medium. In this manner, it is easier to see the color image due to the background being white. Here, the white ink contains a white pigment (a sedimentary substance) as a colorant. Examples of the white pigment are, for example, metal oxides, barium sulfate, calcium carbonate, and the like. Examples of the metal oxides are, for example, titanium dioxide, zinc oxide, silica, alumina, magnesium oxide, and the like. Among these, titanium dioxide is preferable from the point of view of superior white color. It is easy for the white ink to become thicker and solidify when stored for a long period of time. In addition, the white ink in the present embodiment is a sedimentary ink which has a property where it is easy for the pigment to become sediment when stored for a long period of time. Here, sedimentary ink is ink where the light absorption rate is 95% or less within 24 hours.

In this manner, it is possible to reduce the difference in elevation to the relay tank 53 since the ink cartridge W with the white ink which is sedimentary in the present embodiment is accommodated in the ink cartridge accommodating sections 51*c* and 51*d* which are in the upper section. Then, it is possible to minimize the white ink becoming sediment. In addition, since it is possible for the two white ink cartridges to be mounted at the same height, it is possible to set the degree of sediment in the ink in both the white ink cartridges to be uniform.

A total of 20 of the ink cartridges are accommodated in the ink cartridge accommodating sections 51*a* to 51*d* as described above. Then, ink is supplied to the relay tank 53 via tubes from the respective ink cartridges.

The tubes from the ink cartridge side (which are not shown in the diagrams) are connected at an inlet side of the cartridge side solenoid valves 52*a* and 52*b* which are provided in the ink cartridge accommodating sections 51*a* and 51*b* which are on the lower side, and Tc1 is attached at the outlet side. In addition, the tubes from the ink cartridge side (which are not shown in the diagrams) are connected at an inlet side of the cartridge side solenoid valves 52*c* and 52*d* which are provided in the ink cartridge accommodating sections 51*c* and 51*d* which are on the upper side, and the tube Tw1 and the tube Tc1 are attached at the outlet side.

Here, the reference numeral Tw1 is the tube for supplying the white ink in the first ink flow path section. In addition, the reference numeral Tc1 is the tube for supplying color ink and the like (yellow ink, magenta ink, cyan ink, black ink, light magenta ink, light cyan ink, green ink, orange ink, head storage liquid, and liquid retention ink) in the first ink flow path section. The white ink tube Tw1 in the first ink flow path section is curved in a stepped shape.

The ink of each color which is supplied by the relay tank 53 using these tubes is retained in regions which are partitioned for each type of ink. Then, the second ink flow path section is realized using the plurality of tubes Tw2 and Tc2 which are attached to the partitioned regions. The number of tubes in the second ink flow path section is four irrespective of the colors of ink. On the other hand, the first ink flow path section is configured from one color ink tube Tc1 and two white ink tubes Tw1. The reason for the configuration with two white ink tubes Tw1 is to perform removal of sediment by circulating the white ink in Tw1 using a circulation pump 59*tw*1 and performing stirring of the white ink which has become sediment in the first ink flow path section.

In addition, the white ink tube Tw2 in the second ink flow path section is curved in a stepped shape. In this manner, the characteristic of the present embodiment is a feature of the white ink tubes Tw1 and Tw2 having locations where the tubes extend in the vertical direction and locations where the tubes extend in substantially the horizontal direction as shown in FIG. 2. The substantially horizontal direction is so that the angle between the tube which extends in the vertical direction and the tube which extends in the horizontal direction is an angle of approximately 85° in practice.

Here, the diameter of each of the tubes which are used in the first ink flow path section and the second ink flow path section is 3 mm and the dimensions of each stage in the stages (length in the vertical direction) are 50 to 70 mm. For example, six stages are formed when there is a difference in elevation of 330 mm and seven stages are formed when there is a difference in elevation of 410 mm.

Due to this, it is possible to suppress the white ink which is sedimentary ink being concentrated and becoming sediment in the lowest section of the tubes. That is, even when sediment is generated, it is possible to easily eliminate the sedimentary state by circulating ink using the pump or the like due to the sediment being dispersed at locations which are curved by approximately 90°.

Figure 5:
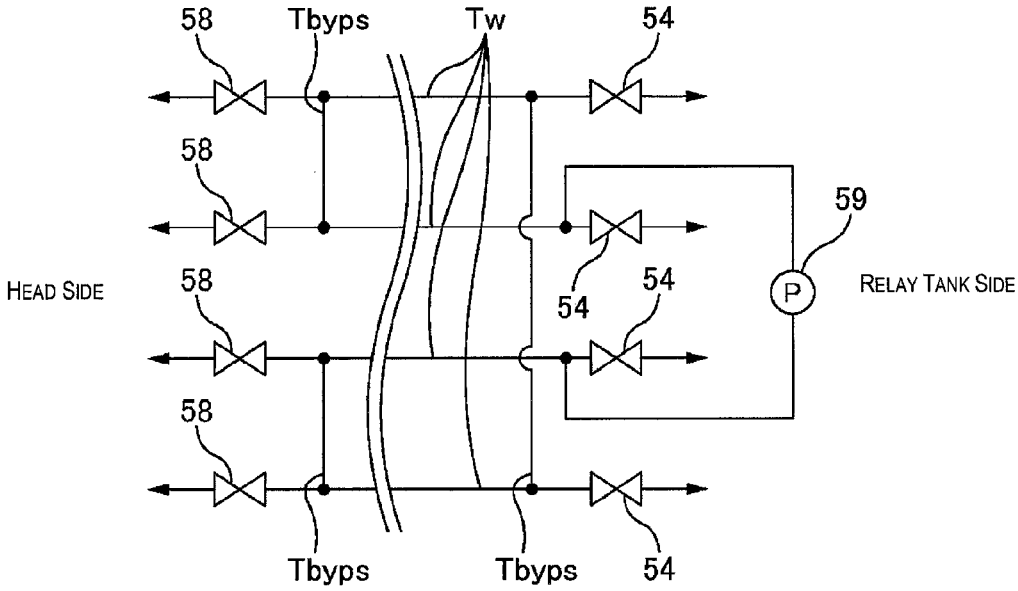
FIG. 5 is an explanatory diagram of a circulation path of white ink.

FIG. 5 is an explanatory diagram of a circulation path of white ink. The upstream side solenoid valve 54, the downstream side solenoid valve 58, the circulation pump 59*tw*1, a circulation pump 59*tw*2, four of the white ink tubes Tw, and joining tubes Tbyps are shown in FIG. 5.

The upstream side solenoid valve 54 and the downstream side solenoid valve 58 are each provided with four of the white ink tubes Tw. Then, the opening and closing of these solenoid valves is controlled by the controller 60.

In FIG. 2, the downstream side solenoid valve 58 is provided in the second ink flow path section, but the attachment position is not limited to this. For example, the attachment position may be in the vicinity of an end edge section of the second ink flow path section, may be in the vicinity of an end edge section of the third ink flow path section, or may be in the vicinity of an end edge section of the fourth ink flow path section. As a result, the reference numerals of the white ink tubes in FIG. 5 are able to be shown using all of Tw2, Tw3, and Tw4 but are shown as Tw for simplification.

Four of the white ink tubes Tw are provided in the present embodiment. Then, the tubes Tw are joined using a plurality of joining tubes Tbyps. For example, in a case where there are a first tube, a second tube, a third tube, and a fourth tube from above in the white ink tubes Tw in FIG. 5, the first tube and the second tube are joined by the joining tube Tbyps immediately before the downstream side solenoid valve 58.

In addition, the third tube and the fourth tube are joined by the joining tube Tbyps immediately before the downstream side solenoid valve 58. In addition, the first tube and the fourth tube are joined by the joining tube Tbyps at the downstream side immediately after the upstream side solenoid valve 54.

In addition, an inlet tube in the circulation pump 59*tw*2 is connected to the downstream side of the solenoid valve 54 in the second tube and an outlet tube in the circulation pump 59*tw*2 is connected to the downstream side of the solenoid valve 54 in the third tube.

In such a configuration, the solenoid valves are closed when the white ink in the tubes Tw is circulated using the circulation pump 59*tw*2. With this arrangement, the tubes configure one circulation path. As a result, since there are not a plurality of circulation paths, it is possible to efficiently circulate the ink by concentrating ink flow energy in one circulation path. Then, it is possible to discharge the white ink from the head after the ink has been circulated using the circulation pump 59*tw*2.

Figure 6A:
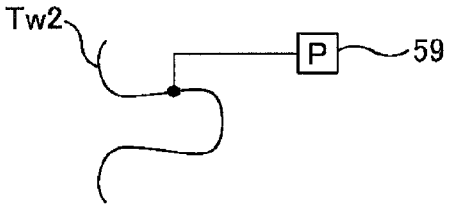
FIG. 6A is a first explanatory diagram of a connection of a circulation pump tube and a white ink tube and FIG. 6B is a second explanatory diagram of a connection of a circulation pump tube and a white ink tube.

FIG. 6A is a first explanatory diagram of a connection of a circulation pump tube and the white ink tube Tw. A state is shown in FIG. 6A where an inlet tube and an outlet tube of the circulation pump 59*tw*2 are connected to a horizontal section of the white ink tube Tw from above.

With this arrangement, it is possible to prevent faults occurring in the circulation pump 59*tw*2 since ink which has become sediment is not introduced into the tubes of the circulation pump 59*tw*2 due to gravity. That is, it is possible to maintain the circulation pump 59*tw*2 in a sound state.

Figure 6B:
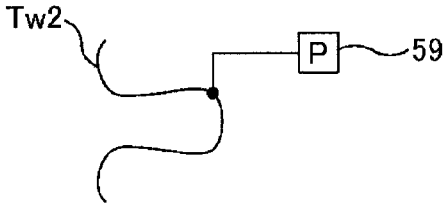

FIG. 6B is a second explanatory diagram of a connection of a circulation pump tube and the white ink tube Tw. A state is shown in FIG. 6B where an inlet tube and an outlet tube of the circulation pumps 59 are connected from an upper portion of a vertical section of the white ink tube Tw (an upper portion of a section which extends in a direction which intersects with a horizontal section in the tube).

By also doing this, it is possible to prevent faults occurring in the circulation pump 59*tw*2 since ink which has become sediment is not introduced into the tubes of the circulation pump 59*tw*2 due to gravity. That is, it is possible to maintain the circulation pump 59*tw*2 in a sound state.

Figure 7:
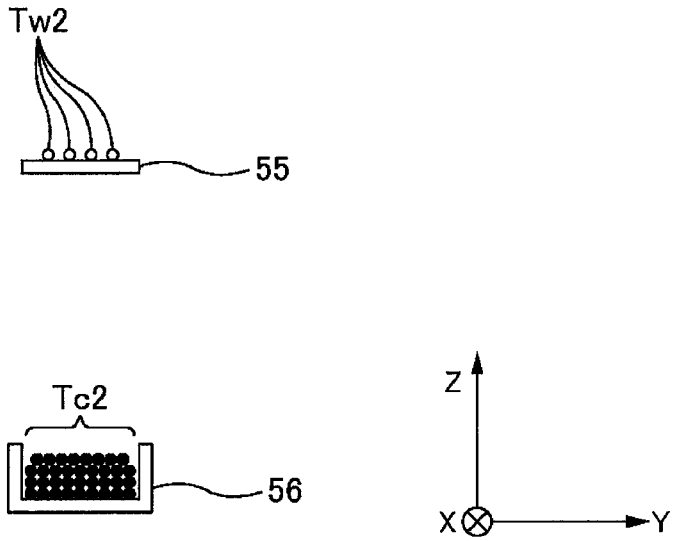
FIG. 7 is a diagram of a cross section A-A in FIG. 2.

FIG. 7 is a diagram of a cross section A-A in FIG. 2. The holding platform 55 and the cable duct 56 are shown in FIG. 7. In addition, a state is shown where the white ink tubes Tw2 are held by the holding platform 55 and the tubes other than the white ink tubes are held by the cable duct 56.

The tube Tc2 with color ink or the like is raised again to the height of the Cableveyor (registered trademark) 57 once having been dropped to the cable duct 56 which is the lowest section, and the white ink tube Tw2 is not lowered to the cable duct 56 which is the lowest section and the height at which the white ink tube is held in the Cableveyor (registered trademark) 57 is at the limit of the lowest height.

In addition, the height of the holding platform 55 is adjusted so that the heights of the lowest section of the white ink tube Tw2 in the second ink flow path section and the white ink tube Tw3 in the third ink flow path section are substantially the same height.

In this manner, it is possible for a difference in elevation which occurs between the Cableveyor (registered trademark) 57 and the cable duct 56 to not occur in the white ink tube Tw2 since the white ink tube Tw2 is held by the holding platform 55. In addition, it is possible to increase the proportion of a portion where the tube is horizontal from immediately before the tube Tw2 enters the Cableveyor (registered trademark) 57 and it is possible for it to be difficult for a state to occur where the white ink is concentrated and has become sediment.

Figure 8:
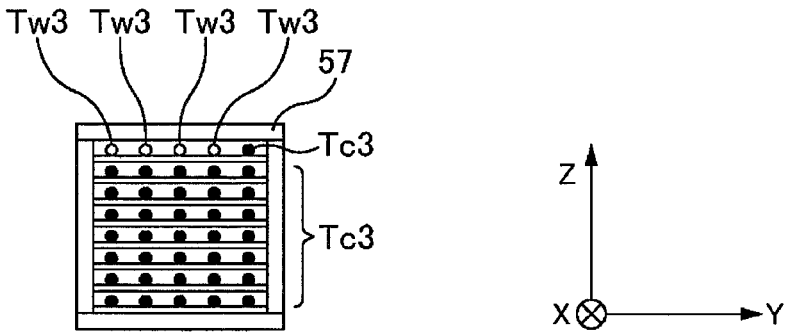
FIG. 8 is a diagram of a cross section B-B in FIG. 2.

FIG. 8 is a diagram of a cross section B-B in FIG. 2. As shown in FIG. 8, the Cableveyor (registered trademark) 57 has a plurality of holding plates for realizing a plurality of mounting heights. Then, four of the white ink tubes Tw3 are held on the holding plate which is at the highest step. On the other hand, the other ink tubes are held at appropriate positions. In this manner, it is possible to minimize the difference in elevation which occurs in relation to the relay tank 53 by all of the white ink tubes being mounted in a line at the highest step. Then, it is possible to minimize the white ink sediment.

In addition, it is assumed that there is a trend where it is easy for ink to become sediment in the tube Tw3 which is mounted at a lower side when a specific tube out of the four tubes Tw3 is mounted at a height which is different, but as described above, faults such as this do not occur since the mounting heights of the white ink tubes Tw3 are the same height.

Figure 9A:
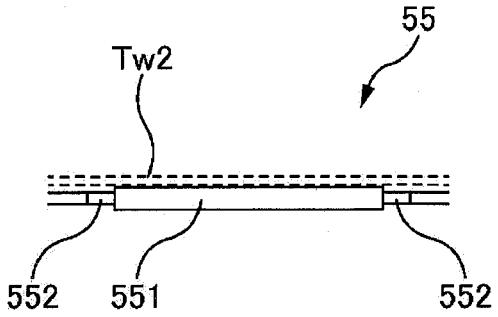
FIGS. 9A and 9B are detailed side surface diagrams of a holding platform.
Figure 9B:
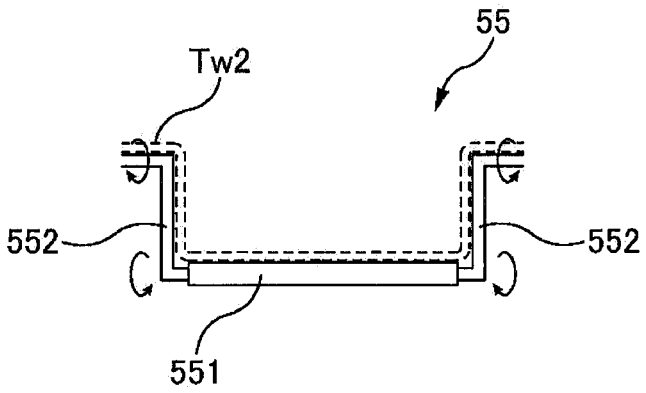
Figure 9B:
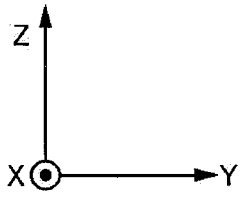
Figure 10A:
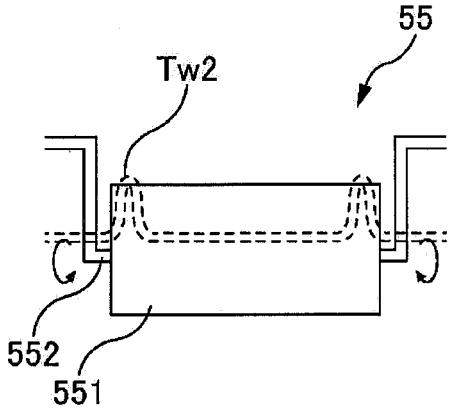
FIGS. 10A and 10B are detailed upper surface diagrams of the holding platform.
Figure 10B:
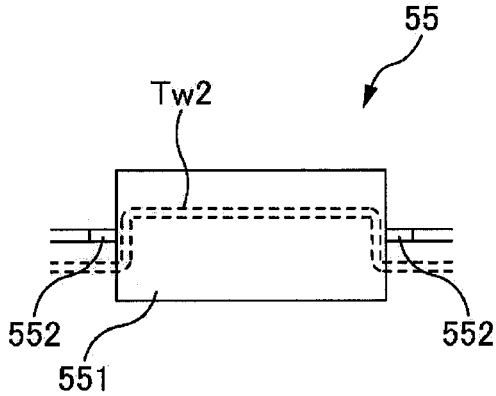
Figure 10B:
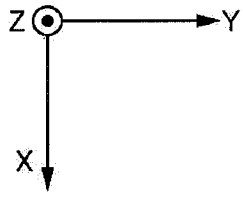

FIG. 9A is a detailed side surface diagram of when the holding platform is in a first state. FIG. 9B is a detailed side surface diagram of when the holding platform is in a second state. FIG. 10A is a detailed upper surface diagram of when the holding platform is in the first state. FIG. 10B is a detailed upper surface diagram of when the holding platform is in the second state.

A holding platform body 551 and a crank member 552 are shown in the diagrams as the holding platform 55. Four of the tubes Tw2 are held in the holding platform body 551 in essence, but only one is shown by a dashed line for simplicity of the description here.

The first state in FIG. 9A and FIG. 10A is a state where the holding platform body 551 is maintained at the height of the Cableveyor (registered trademark) 57 and is a state where the heights of the white ink tube Tw2 on the holding platform body 551 and the white ink tubes Tw3 in the Cableveyor (registered trademark) 57 are maintained at the same height. On the other hand, the second state is a state where the holding platform body 551 is lowered to a position which is substantially the same as the cable duct 56.

One edge of the crank member 552 in the center axis in the longitudinal direction is attached to both edges of the holding platform body 551 so as to be able to rotate. The other edge of the crank member 552 is attached to the body of the printer 1 so as to be able to rotate. By the crank member 552 rotating as a shaft, it is possible for the holding platform body 551 to be moved in an up and down direction as shown in FIG. 9A, FIG. 9B, FIG. 10A, and FIG. 10B and the position of the white ink tubes Tw2 which are held by the holding platform body 551*a* re also moved to a position of the first state and a position of the second state. Here, as shown in FIG. 10A, surplus length is provided in the tubes Tw2 which are held by the holding platform 55 so that it is possible to move in the height direction when moving of the holding platform 55 up and down is performed. In addition, although not shown in the diagram, the printer 1 has a fixing member which fixes the holding platform body 551 in the first state at an inner section of the printer 1.

Due to this, the holding platform body 551 is held at the position of the first state during normal printing. On the other hand, in a case of maintenance on the white ink tubes Tw2, it is possible to carry out maintenance of the color ink tubes Tc2 and the white ink tubes Tw2 by the positions of the tubes being moved to positions which are substantially the same as the cable duct 56.

Here, the printer 1 in the present embodiment performs printing by discharging ink while the head 31 is being moved above the printing medium. As a result, the movement of the head 31 is controlled by the carriage unit 40. In addition, in order for the head 31 to be moved by the carriage unit 40, it is necessary for the ink tubes to also move so as to follow this movement. As a result, it is possible for the plurality of ink tubes to be held in the Cableveyor (registered trademark) 57 and to move in a predetermined range as described above.

The front edges of the outlet of the plurality of tubes which are held in the Cableveyor (registered trademark) 57 are bonded via a bonding section in the head 31.

Figure 11:
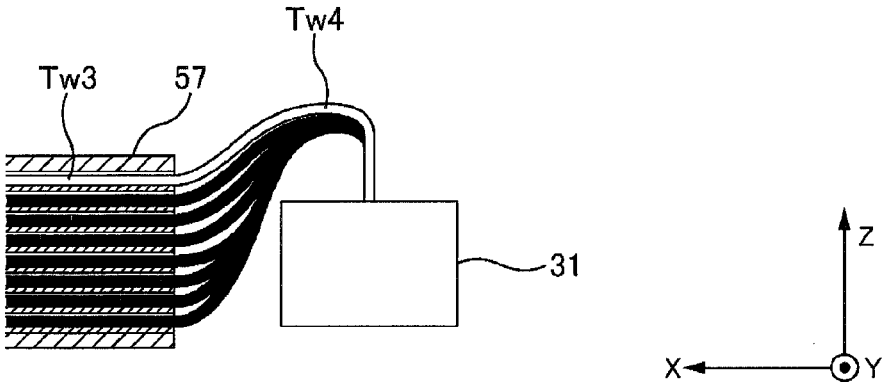
FIG. 11 is a first explanatory diagram of a bonding section with a head.

FIG. 11 is a first explanatory diagram of a bonding section with the head. The outlet of the Cableveyor (registered trademark) 57 and the head 31*a* re shown in FIG. 11. Then, the positions of the tubes between the outlet of the Cableveyor (registered trademark) 57 and the head 31*a* re shown. Here, the white ink tube is shown by the reference numeral Tw4 and the color ink tube is shown by the reference numeral Tc4.

The bonding section of the white ink tube Tw4 in the head 31 is positioned above the lowest tube in the Cableveyor (registered trademark) 57 as shown in FIG. 11. Here, as described above, the white ink tube Tw4 is positioned at a position of the mounting height which is the highest in the Cableveyor (registered trademark) 57.

With this arrangement, it is possible to suppress the difference in elevation between the bonding section in the head 31 and the white ink tube Tw4 in the Cableveyor (registered trademark) 57 to a minimum. Then, it is possible for it to be difficult for a state where the white ink is concentrated and has become sediment to occur in a specific part.

Figure 12:
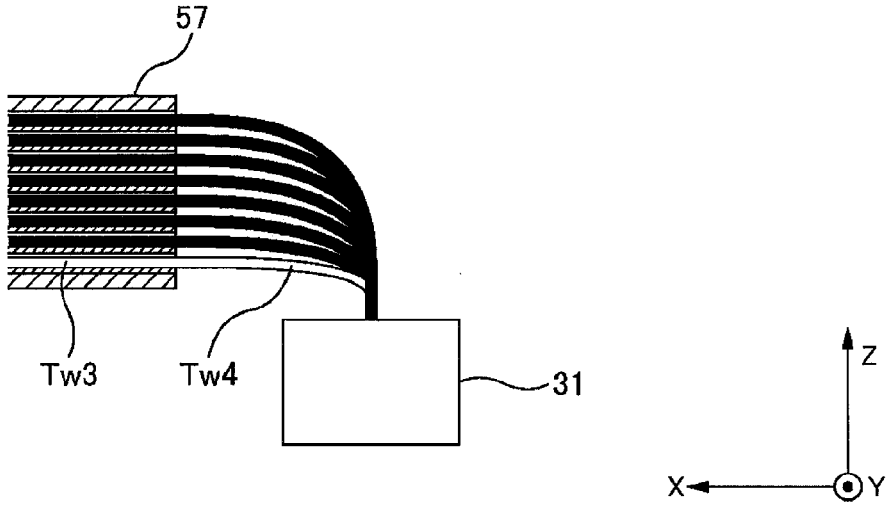
FIG. 12 is a second explanatory diagram of the bonding section with the head.

FIG. 12 is a second explanatory diagram of a bonding section with the head. FIG. 12 describes a second embodiment of the bonding section with the head. The head 31 in FIG. 11 described above is relatively positioned with regard to the Cableveyor (registered trademark) 57 above the lowest tube. In contrast to this, in FIG. 12, the bonding section of the white ink tube Tw4 and the head 31 is positioned below the lowest tube in the Cableveyor (registered trademark) 57. In addition, the white ink tube Tw4 is also mounted at a position of the mounting height which is the lowest in the Cableveyor (registered trademark) 57.

Even with relative positioning such as this, it is possible to suppress the difference in elevation of the bonding section of the white ink tube Tw4 and the head 31 and the white ink tube Tw4 in the Cableveyor (registered trademark) 57 to a minimum. Then, it is possible for it to be difficult for a state where the white ink is concentrated and has become sediment to occur in a specific part.

Figure 13:
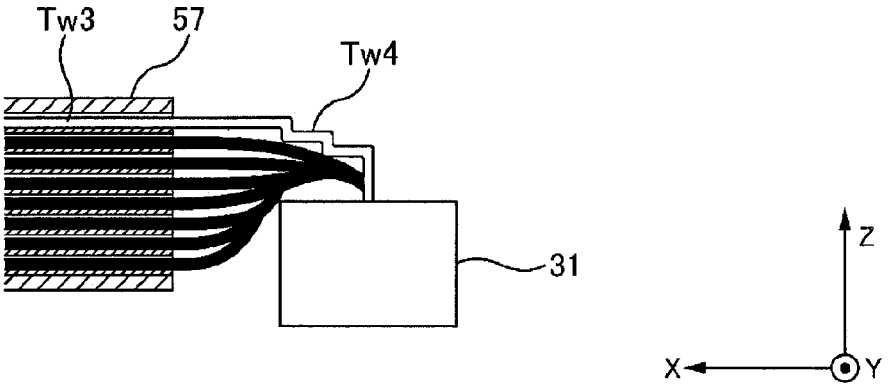
FIG. 13 is a third explanatory diagram of the bonding section with the head.

FIG. 13 is a third explanatory diagram of a bonding section with the head. FIG. 13 describes a third embodiment of the bonding section with the head. In FIG. 13, the white ink tube Tw4 between the Cableveyor (registered trademark) 57 and the head 31 is a shape with steps. In detail, there are locations where the tube extends in the vertical direction and locations where the tube extends in substantially the horizontal direction. The substantially horizontal direction is so that the angle between the tube which extends in the vertical direction and the tube which extends in the horizontal direction is an angle of approximately 85° in practice.

With this arrangement, it is possible to suppress the white ink which is sedimentary ink being concentrated and becoming sediment at the lowest section of the tube.

Other Embodiments

In the embodiment described above, a sedimentary ink has been described as the white ink but the type of sedimentary ink is not limited to this.

In addition, the printer 1 has been described as the liquid discharge apparatus in the embodiment described above but the liquid discharge apparatus is not limited to this and it is possible for the liquid discharge apparatus to be realized as a liquid discharge apparatus which ejects or discharges a fluid other than ink (a liquid, a liquid body where particles of a function material are dispersed, or a fluid body such as a gel). For example, the same technique as the embodiment described above may be applied to various types of apparatuses where an ink jet technique is applied such as a color filter manufacturing apparatus, a dyeing apparatus, a microprocessing apparatus, a semiconductor manufacturing apparatus, a surface processing apparatus, a three dimensional molding apparatus, a gas vaporizing apparatus, an organic EL manufacturing apparatus (in particular, a polymer EL manufacturing apparatus), a display manufacturing apparatus, a film forming apparatus, or a DNA chip manufacturing apparatus. In addition, these methods and manufacturing methods are categorized in the scope of the application.

The embodiment described above is for it to be easy to understand the present invention and is not to be interpreted as limiting the invention. It goes without saying that the present invention is able to be achieved by modifications or alteration without departing from the gist of the invention and substitutes are included in the present invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid discharge apparatus comprising:

an ink tank configured and arranged to retain a plurality of types of ink including pigment-based ink;

a head configured and arranged to discharge the ink; and an ink supply path section configured and arranged to supply the ink from the ink tank to the head, the ink supply path section including a plurality of ink tubes and an elongated member supporting and guiding apparatus accommodating the ink tubes, the ink tubes having a plurality of pigment-based ink tubes for the pigment-based ink, the elongated member supporting and guiding apparatus having a first end and a second end opposite the first end in an elongated direction of the elongated member supporting and guiding apparatus, the ink tubes entering into the elongated member supporting and guiding apparatus at the first end, and going out from the elongated member supporting and guiding apparatus at the second end, the elongated member supporting and guiding apparatus further having at least one holding plate disposed therein and extending along the elongated direction of the elongated member supporting and guiding apparatus until reaching the second end, the holding plate separating the elongated member supporting and guiding apparatus into at least two accommodation portions in a vertical direction perpendicular to the elongated direction, the accommodation portions being configured to accommodate the ink tubes, the pigment-based ink tubes being mounted in the elongated member supporting and guiding apparatus such that a part of each of the pigment-based ink tubes, which is in contact with the at least one holding plate and extends to reach the second end in one of the accommodation portions of the elongated member supporting and guiding apparatus, maintains the same position in the vertical direction.

2. The liquid discharge apparatus according to claim 1, wherein a bonding section of the pigment-based ink tubes and the head is positioned at a higher section than an ink tube mounted in one of the accommodation portions, which is positioned lowest in the elongated member supporting and guiding apparatus in the vertical direction, and the pigment-based ink tubes are mounted in one of the accommodation portions highest positioned inside the elongated member supporting and guiding apparatus in the vertical direction.

3. A liquid discharge apparatus comprising:

an ink tank configured and arranged to retain a plurality of types of ink including pigment-based ink;

a head configured and arranged to discharge the ink; and an ink supply path section configured and arranged to supply the ink from the ink tank to the head, the ink supply path section including an elongated member supporting and guiding apparatus accommodating a plurality of ink tubes, a plurality of pigment-based ink tubes among the plurality of ink tubes being mounted at the same height in a height direction inside the elongated member supporting and guiding apparatus, the elongated member supporting and guiding apparatus having a plurality of mounting heights for the ink tubes inside the elongated member supporting and guiding apparatus, a bonding section of the pigment-based ink tubes and the head being positioned at a lower section than a lowest tube in the elongated member supporting and guiding apparatus, and the pigment-based ink tubes being mounted at a position which is a lowest mounting height inside the elongated member supporting and guiding apparatus in the vertical direction.

4. A liquid discharge apparatus comprising:

an ink tank configured and arranged to retain a plurality of types of ink including pigment-based ink;

a head configured and arranged to discharge the ink; and an ink supply path section configured and arranged to supply the ink from the ink tank to the head, the ink supply path section including an elongated member supporting and guiding apparatus accommodating a plurality of ink tubes, a plurality of pigment-based ink tubes among the plurality of ink tubes being mounted at the same height in a height direction inside the elongated member supporting and guiding apparatus, the pigment-based ink tubes between the elongated member supporting and guiding apparatus and the head being tubes with a stepped shape.

5. A liquid discharge apparatus comprising:

an ink tank configured and arranged to retain a plurality of types of ink including pigment-based ink;

a head configured and arranged to discharge the ink;

an ink supply path section configured and arranged to supply the ink from the ink tank to the head, the ink supply path section including an elongated member supporting and guiding apparatus accommodating a plurality of ink tubes; and a holding platform holding the pigment-based ink tubes at the same height as a mounting height of the pigment-based ink tubes in the elongated member supporting and guiding apparatus between the ink tank and the elongated member supporting and guiding apparatus, a plurality of pigment-based ink tubes among the plurality of ink tubes being mounted at the same height in a height direction inside the elongated member supporting and guiding apparatus.

6. The liquid discharge apparatus according to claim 5, wherein the holding platform is configured and arranged to move up and down in the height direction.

7. The liquid discharge apparatus according to claim 6, wherein the pigment-based ink tubes between the elongated member supporting and guiding apparatus and the holding platform have a length that allows a change in the height direction when up and down movement of the holding platform is performed in the height direction.

8. The liquid discharge apparatus according to claim 5, wherein the ink tubes for the color inks out of the plurality of types of ink are mounted at positions lower than the holding platform in at least a portion between the ink tank and the elongated member supporting and guiding apparatus.

* * * * *